US006412894B1

(12) United States Patent
Askren et al.

(10) Patent No.: US 6,412,894 B1
(45) Date of Patent: Jul. 2, 2002

(54) INK CARTRIDGE AND METHOD FOR DETERMINING INK VOLUME IN SAID INK CARTRIDGE

(75) Inventors: Benjamin Alan Askren; William Paul Cook, both of Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 40 days.

(21) Appl. No.: 09/766,363

(22) Filed: Jan. 19, 2001

(51) Int. Cl.[7] ..... B41J 2/195
(52) U.S. Cl. ..... 347/7
(58) Field of Search ..... 347/7, 31, 84, 347/87, 85, 86, 3, 108, 20, 23, 40, 47, 42, 6, 18

(56) References Cited

U.S. PATENT DOCUMENTS

| | | | |
|---|---|---|---|
| 5,079,570 | A | 1/1992 | Mohr et al. |
| 5,289,211 | A | 2/1994 | Morandotti et al. |
| 5,315,317 | A | 5/1994 | Terasawa et al. |
| 5,509,140 | A | 4/1996 | Koitabashi et al. |
| 5,537,134 | A | 7/1996 | Baldwin et al. |
| 5,572,241 | A | 11/1996 | Kanayama et al. |
| 5,574,484 | A | 11/1996 | Cowger |
| 5,583,544 | A | 12/1996 | Stamer et al. |
| 5,583,545 | A | 12/1996 | Pawlowski, Jr. et al. |
| 5,623,291 | A | 4/1997 | Morandotti et al. |
| 5,635,962 | A | 6/1997 | Goldis |
| 5,680,164 | A | 10/1997 | Miller et al. |
| 5,682,183 | A | 10/1997 | Wade et al. |
| 5,691,750 | A | 11/1997 | Edwards |
| 5,699,090 | A | 12/1997 | Wade et al. |
| 5,709,253 | A | 1/1998 | Maerzke |
| 5,721,573 | A | 2/1998 | Benjamin |
| 5,736,992 | A | 4/1998 | Pawlowski, Jr. |
| 5,742,311 | A | 4/1998 | Koitabashi et al. |
| 5,757,406 | A | 5/1998 | Kaplinsky et al. |
| 5,788,388 | A | 8/1998 | Cowger et al. |
| 5,815,175 | A | 9/1998 | Seikel |
| 5,818,471 | A | 10/1998 | Shimamura et al. |
| 5,835,817 | A | 11/1998 | Bullock et al. |
| 5,842,800 | A | 12/1998 | Bailey et al. |
| 5,844,577 | A | 12/1998 | Pawlowski, Jr. |
| 5,929,875 | A | 7/1999 | Su et al. |
| 5,956,057 | A | 9/1999 | Childers et al. |
| 5,966,144 | A | 10/1999 | Edwards |

*Primary Examiner*—Raquel Yvette Gordon
(74) *Attorney, Agent, or Firm*—D. Brent Lambert; Ronald K. Aust

(57) ABSTRACT

An ink cartridge carrying a supply of ink includes a base assembly forming an ink reservoir. A first ink tank is provided having a foam core for carrying the ink, the foam core being coupled in fluid communication with the ink reservoir. A second ink tank is provided having a bladder for carrying the ink, the bladder being coupled in fluid communication with the ink reservoir and coupled in fluid communication with the first ink tank via said ink reservoir.

37 Claims, 6 Drawing Sheets

INK CARTRIDGE AND METHOD FOR DETERMINING INK VOLUME IN SAID INK CARTRIDGE

BACKGROUND OF THE INVENTION

1. Field of the Invention

The present invention relates to ink jet printing, and, more particularly, to an ink cartridge and associated method of determining an ink volume in the ink cartridge.

2. Description of the Related Art

Over the years, a variety of ink cartridge configurations have been developed, and a number of approaches have been taken to determine the ink level in an ink cartridge prior to the depletion of the ink supply within the cartridge.

One approach is to start with a known full quantity of ink and merely count the number of ejected drops until the number of ink drops ejected corresponds to a predicted number of drops associated with an empty condition. Such an approach, however, can provide erroneous results as the quantity of ink of each drop varies due to changes in ambient temperature and pressure, as well as changes in an ink jet cartridge's nozzle opening size, printhead temperature and internal pressure.

Another approach is to warm the print cartridge printhead and ink to a predetermined temperature. The print cartridge printhead is operated at a first firing frequency to eject a volume of ink. This operation includes heating the ink and the printhead, carrying away heat in the ejected volume of ink, and conveying a volume of cooler ink to the printhead to replace the ejected volume. A first temperature change from the predetermined temperature is monitored. The same print cartridge printhead and ink are then again warmed to a predetermined temperature. The print cartridge printhead is operated at a second firing frequency that is different than the first firing frequency to eject a volume of ink. This operation includes heating the ink and the printhead, carrying away heat in the ejected volume of ink, and conveying a volume of cooler ink to the printhead to replace the ejected volume. A second temperature change from the predetermined temperature is monitored. The first and second temperature changes are compared to indicate a low ink supply that may result in the replacement of print cartridge. Such an approach, however, is complex and is wasteful of ink.

Another approach is to provide a capacitive sensor, wherein on opposing sides of an ink cartridge, a first set of plates is positioned parallel to a second set of plates. A bag containing ink is positioned between the first and the second set of plates. An electrical source applies an alternating electric field to the first and the second set of plates. A capacitance meter measures the capacitance between the first set of plates and bag and the capacitance between the second set of plates and bag. The more ink, the closer the bag is to the plates and the higher the capacitance. Such an approach, however, is dependent upon maintaining a proper relationship between the plates as the ink is depleted.

In still another approach, ink from an ink reservoir flows to a first containment chamber, which in turn flows into a second containment chamber. As the depleting local supply of ink in first containment chamber decreases, because the second containment chamber is sealed against the ambient atmosphere, a low pressure condition occurs. As the pressure drops within the containment chambers, ambient air pressure via an ambient atmosphere vent inflates a bag member based upon the increasing pressure differential. Electrical or electromagnetic devices are used individually or in combination with a pressure regulator apparatus to sense the back pressure in the containment device after the reservoir has gone dry to trigger a signal indicating a low or out-of-ink condition. In such an approach, however, the ink level measurement point is at an empty extreme of the reservoir volume, which may not give adequate warning to the user that the cartridge must be replaced.

It is known to include a foam core in an ink container to serve as a pressure regulator. FIG. 1 shows a graph depicting the relationship between ink volume (y-axis) and ink container back pressure (x-axis) in a prior art foam ink cartridge. It should be noted from FIG. 1 that the most significant changes in back pressure occur in relation to a relatively small change in ink volume, and occur before a near full level 10 (approximately one-fourth of the ink depleted) and after a near empty level 12 (approximately one-fourth of the ink remaining), and that the major change in ink volume between the near full level 10 and the near empty level 12 results in a relatively small change in back pressure.

FIG. 2 shows a graph depicting the relationship between ink volume (y-axis) and ink container back pressure (x-axis) in a prior art ink cartridge containing a bladder as a pressure regulating device. Again, it should be noted that the most significant changes in back pressure occur in relation to a relatively small change in ink volume, and occur before a near-full level 14 (approximately one-fourth of the ink depleted) and after a near empty level 16 (approximately one-fourth of the ink remaining), and that the major change in ink volume between the near full level 14 and the near empty level 16 results in a relatively small change in back pressure.

In comparing the graph of FIG. 2 with the graph of FIG. 1, however, it is noted a higher degree of backpressure change occurs above near full level 14 of FIG. 2 than occurs above near full level 10 of FIG. 1. However, in both cases, a simple sensor would be incapable of correlating a pressure change occurring within the near full or the near empty ink levels that could be meaningfully correlated to an intermediate ink volume level.

What is needed in the art is an improved ink cartridge having a replaceable ink tank for replenishing the supply of ink contained in the ink cartridge. In addition, what is needed in the art is an ink volume sensor that identifies an intermediate ink volume level so as to permit a timely and beneficial warning to the user of a depletion of the ink below a certain ink volume level well before the empty condition is reached within the ink cartridge.

SUMMARY OF THE INVENTION

One aspect of the present invention provides an improved ink cartridge having a replaceable ink tank for replenishing the supply of ink contained in the ink cartridge. The invention comprises, in one form thereof, an ink cartridge carrying a supply of ink. The ink cartridge includes a base assembly forming an ink reservoir. A first ink tank is provided having a foam core for carrying the ink, the foam core being coupled in fluid communication with the ink reservoir. A second ink tank is provided having a bladder for carrying the ink, the bladder being coupled in fluid communication with the ink reservoir and coupled in fluid communication with the first ink tank via the ink reservoir.

Another aspect of the present invention provides an ink cartridge having an ink volume sensor that identifies an intermediate ink volume level so as to permit a timely and beneficial warning to the user of a depletion of the ink below a certain ink volume level before the empty condition is reached within the ink cartridge. Thus, another form of the invention comprises a sensor provided for detecting a pressure change in the ink reservoir corresponding to a substantial depletion of the ink contained in the first ink tank while the second ink tank retains an amount of ink above a near-full level.

An advantage of the present invention is that the first ink tank can be replaced multiple times during the life of the ink cartridge.

Another advantage is that the first tank can be replaced any time after the first tank is determined to be substantially empty but before the second ink tank is empty, thereby reducing the number of operator interactions with the ink cartridge.

Another advantage of the present invention is that an intermediate ink volume level of the ink cartridge can be identified so as to permit a timely and beneficial warning to the user of a depletion of the ink below a certain ink level well before the empty condition is reached within the ink cartridge.

Another advantage is that a simple sensor can be used in detecting the intermediate ink level associated with the ink cartridge.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate preferred embodiments of the invention, and such exemplifications are not to be construed as limiting the scope of the invention in any manner.

DETAILED DESCRIPTION OF THE INVENTION

Figure 1:
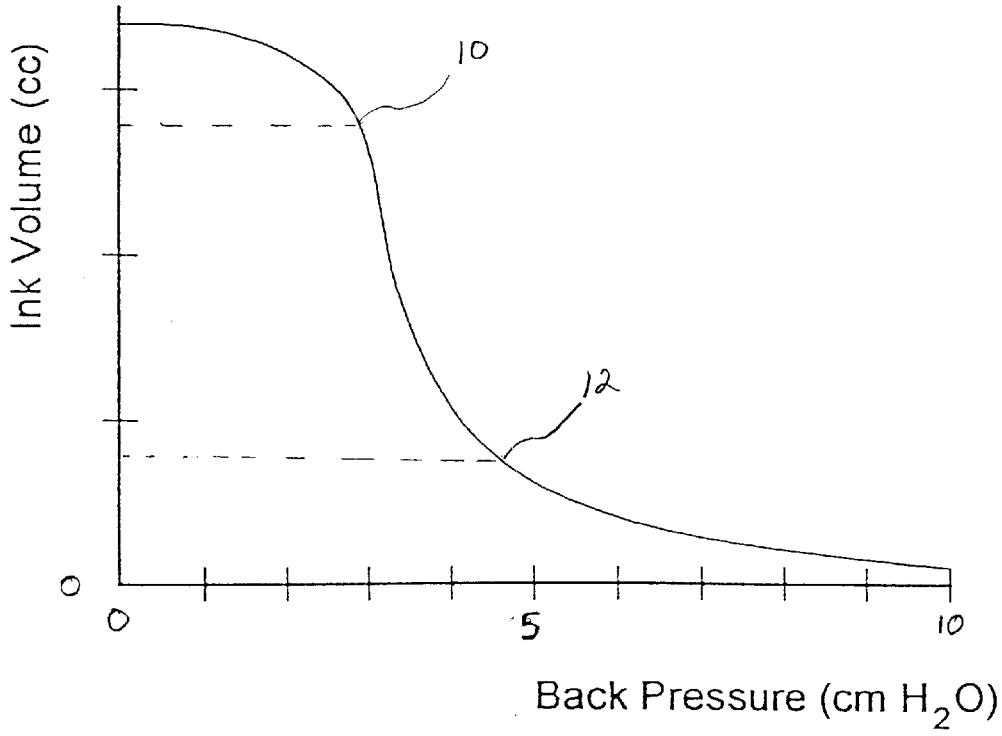
Fig. 1 (Prior Art)
FIG. 1 is a graph plotting backpressure vs. ink volume in a typical prior art ink jet cartridge containing a foam core.
Figure 2:
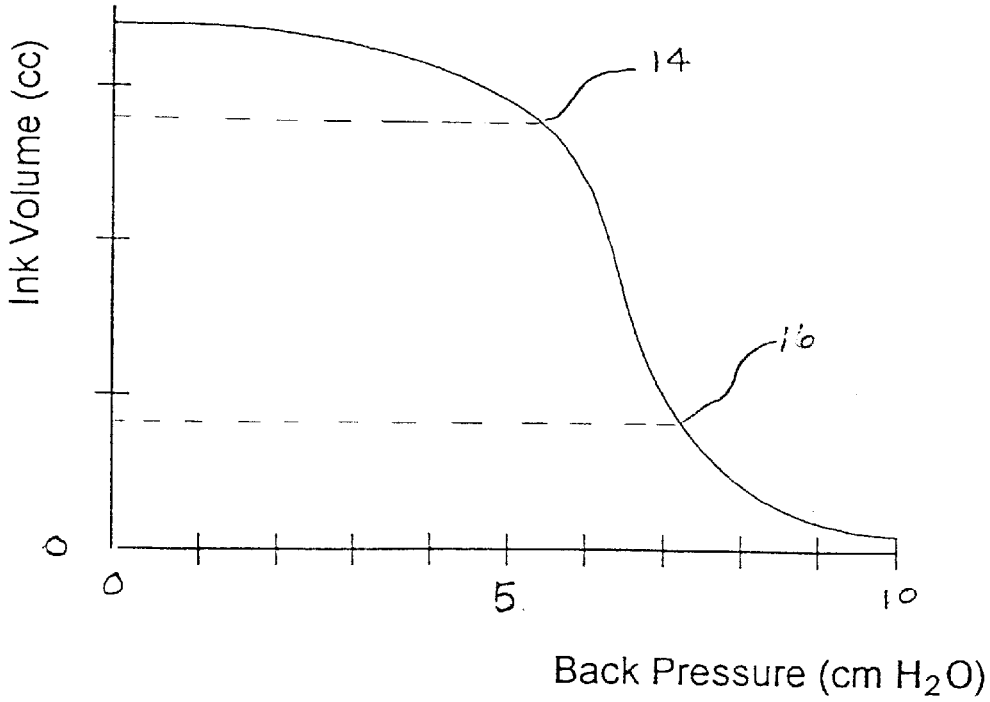
Fig. 2 (Prior Art)
FIG. 2 is a graph plotting backpressure vs. ink volume in a typical prior art ink jet cartridge containing a bladder.
Figure 3:
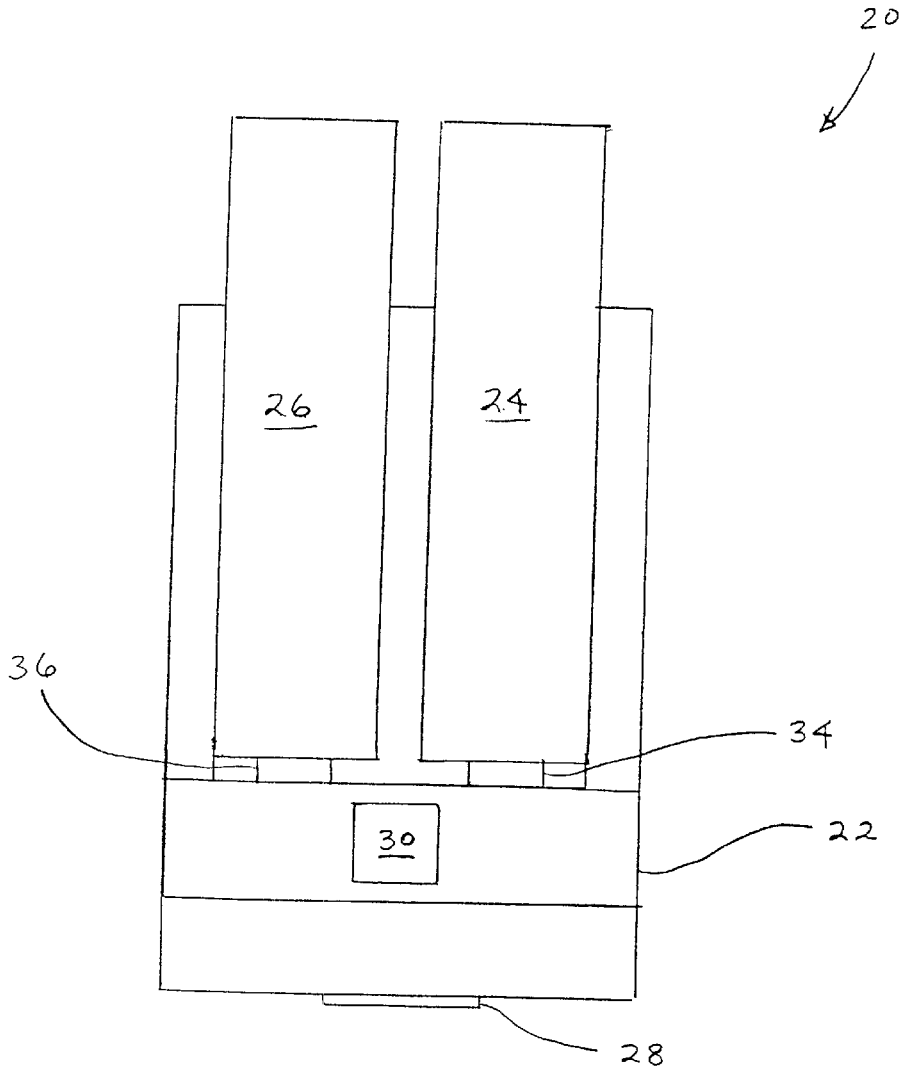
FIG. 3 is a block diagram of an end view of an ink jet cartridge embodying the present invention.
Figure 4:
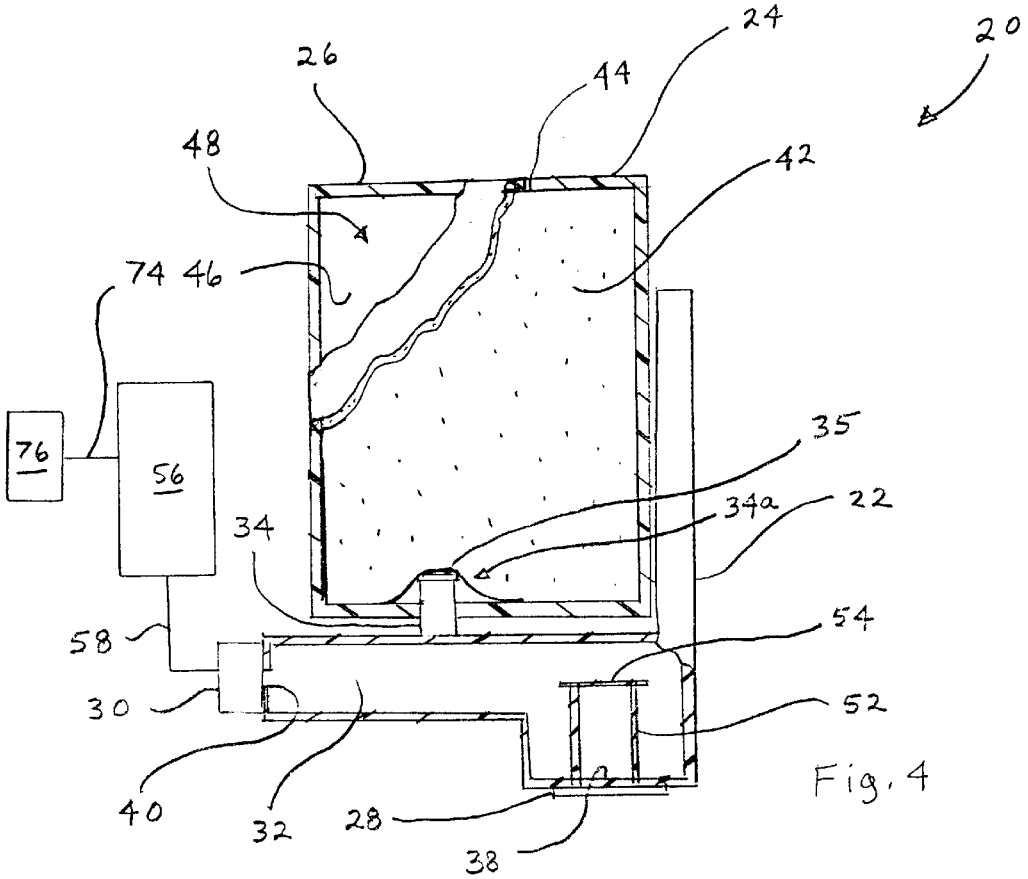
FIG. 4 is a sectioned side view of the ink jet cartridge of FIG. 3 with a portion of the right ink tank broken away.

Referring now to the drawings and particularly to FIGS. 3 and 4, there is shown an ink cartridge 20 embodying the invention. Ink jet cartridge 20 contains a supply of ink having an ink volume which ranges from full to empty, and wherein a detectable pressure change occurs at an intermediate ink volume level within the range. Ink cartridge 20 includes a base assembly 22, a first ink tank 24, a second ink tank 26, a printhead nozzle plate 28 and a sensor 30. In FIG. 4, a portion of first ink tank 24 is broken away to expose a portion of second ink tank 26.

Base assembly 22 forms an ink reservoir 32 that can receive ink from ink tanks 24, 26. Ink reservoir 32 includes a first port 34, a second port 36, a third port 38 and a fourth port 40.

Figure 6:
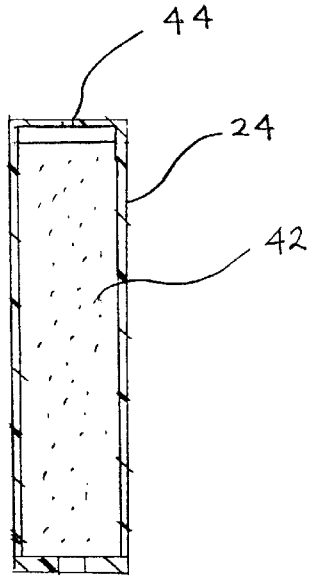
FIG. 6 is a sectioned end view of an ink tank of the ink jet cartridge of FIG. 3 that contains a foam core.

First ink tank 24 is detachably attachable with base assembly 22, and second ink tank 26 is not detachably attachable with the base assembly 22. First ink tank 24 has a foam core 42 (see also FIG. 6) for carrying the ink. The interior of ink tank 24, including foam core 42, is coupled in fluid communication with first port 34 of ink reservoir 32. A screen 35 is positioned over a first end 34*a* of first port 34. First port 34 serves as a refill pipe for ink cartridge 20, wherein the refill pipe is attached to base assembly 22. Screen 35 provides a barrier to air passage from foam core 42 into ink reservoir 32 of base assembly 22. Screen 35 is wetted with ink and uses the high surface tension forces of the ink in screen 35 to resist air flow into ink reservoir 32. When screen 35 is submerged in ink, it provides little impedance to fluid flow. Screen 35 also captures particulate material from the ink supplied from first ink tank 24. A vent 44 is provided in first ink tank 24 to couple the interior of ink tank 24 in fluid communication with the atmosphere.

Figure 5:
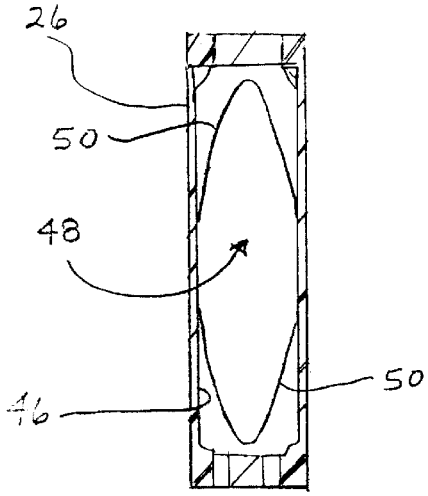
FIG. 5 is a sectioned end view of an ink tank of the ink jet cartridge of FIG. 3 that contains a bladder.

Second ink tank 26 has a bladder 46 (see also FIG. 5) for carrying the ink. Bladder 46 is formed as a foil liner within second ink tank 26. An interior region 48 of bladder 46 is coupled in fluid communication with second port 36 of ink reservoir 32. A leaf spring 50, preferably made of metal, is positioned inside bladder 46 to resist a collapsing of bladder 46 as a result of changes in back pressure within second ink tank 26.

Printhead nozzle plate 28 includes a plurality of ink jetting nozzles (not shown), and is coupled in fluid communication with third port 38 of ink reservoir 32 via a stand pipe 52 and a screen filter 54. Each of the plurality of ink jetting nozzles are controllable to selectably expel ink in a manner well know in the art.

Sensor 30 is coupled in fluid communication with fourth port 40 of ink reservoir 32 and is provided to detect a pressure change in ink reservoir 32 corresponding to a substantial depletion of the ink contained in first ink tank 24. Sensor 30 is connected in electrical communication to a processor 56 via a communication link 58.

Figure 7:
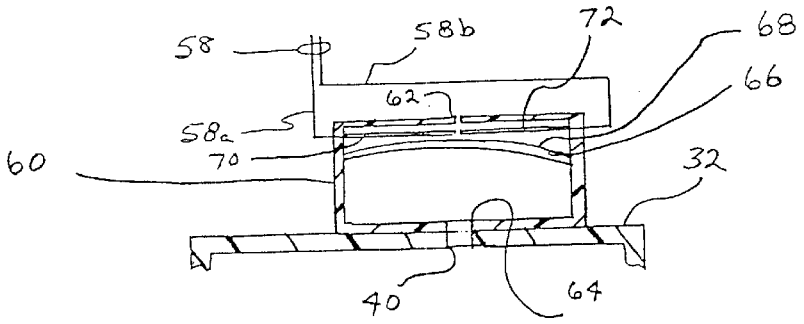
FIG. 7 is a sectioned side view of the sensor of the ink jet cartridge of FIG. 3.

Sensor 30 is a simple sensor that generates a first signal indicating that a pressure threshold has not been reached and generates a second signal indicating that the pressure threshold has been reached. Sensor 30 may have a structure, for example, of the type depicted in FIG. 7. As shown in FIG. 7, sensor 30 includes a housing 60 having a vent 62 and a sensor port 64. Contained in housing 60 is a deformable diaphragm 66 having a conductive surface 68. Also, positioned in housing 60 in close proximity to conductive surface 68 is a pair of electrical contacts 70, 72. Electrical contacts 70, 72 are connected to individual conductors 58*a*, 58*b* of communication link 58. One side of diaphragm 66 is exposed to ambient air via vent 62, and the other side of diaphragm 66 is exposed to ink in ink reservoir 32 via fourth port 40 and sensor port 64. When conductive surface 68 is in contact with electrical contacts 70, 72, an electrical conduction path is completed, i.e., closed, between conductors 58*a* and 58*b*. When conductive surface 68 is not in contact with electrical contacts 70, 72, then the electrical conduction path is open between conductors 58*a* and 58*b*. The first signal is associated with the closed circuit condition and the second signal is associated with the open circuit condition. The first and second signals are received by processor 56 via communication link 58.

During use of the present invention depicted in FIGS. 3–7, initially, both first ink tank 24 and second ink tank 26 are filled with a substantially equal amount of ink. However, due to the differences in the operating characteristics of first ink tank 24 and second ink tank 26, first ink tank 24 will be substantially depleted of ink prior to second ink tank 26 supplying ink to the ink reservoir 32.

Figure 8:
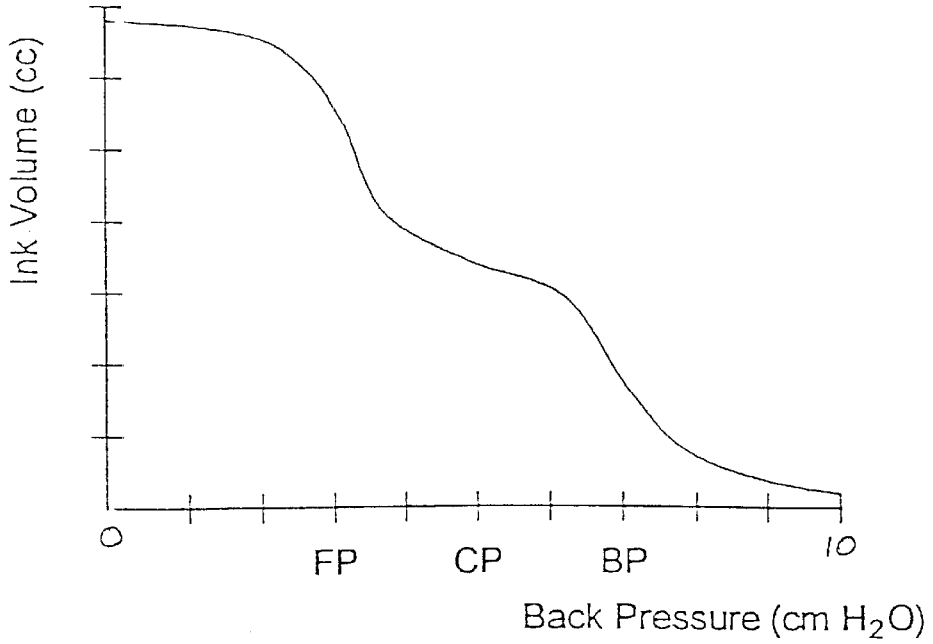
FIG. 8 is a graph plotting backpressure vs. ink volume in the ink jet cartridge of the present invention.

Referring now to FIG. 8, as first ink tank 24 becomes substantially depleted of ink, and as second ink tank 26 begins supplying ink to ink reservoir 32, a substantial change in backpressure occurs as the backpressure changes from the backpressure FP of foam core first ink tank 24 to that of the backpressure BP of bladder-lined second ink tank 26. A critical pressure CP occurs between backpressures FP and BP, and corresponds to a pressure threshold PT of sensor 30. When the backpressure in ink reservoir 32 is below critical pressure CP, sensor 30 is in a closed circuit condition. As the backpressure in ink reservoir 32 increases above critical pressure CP, the sensor 30 changes from the closed circuit condition to an open circuit condition. Processor 56 detects the change of sensor 30 from the closed circuit condition (first signal) to the open circuit condition (second signal), and processor 56 conveys a warning message to a user via communication link 74 and a warning unit 76, such as an audible alarm or visual warning indicator (see FIG. 4).

With second ink tank 26 being substantially full of ink initially, the occurrence of reaching the critical pressure CP corresponds to a time at which the total supply of ink available from ink cartridge 20 is at an intermediate level between full and empty. Continued use of ink cartridge 20 following the occurrence of critical pressure CP results in second ink tank 26 supplying ink to printhead nozzle plate 28, thereby reducing the supply of ink contained in second ink tank 26. Upon replacing the depleted first ink tank 24 with a similar foam containing ink tank having a fall supply of ink, ink from first ink tank 24 is transferred from first ink tank 24 to second ink tank 26 via ink reservoir 32 until second ink tank 26 is nearly full, and first ink tank 24 again serves as the source of ink to be emitted from printhead nozzle plate 28.

If printing continues after reaching critical pressure CP, then processor 56 tallies a count of the number of ink jet nozzle firings occurring after reaching the critical pressure CP. The tally of the number of ink jet nozzle firings then is used to predict an ink level of second ink tank 26 by comparing the tally count to a near empty count associated with a near empty condition. Alternatively, a counter within processor 56 having an initial count corresponding to a full condition of second ink tank 26 can be decremented for each nozzle firing to determine when second ink tank 26, and thus ink jet cartridge 20, is considered near empty, i.e., a near empty count. Once processor 56 determines that the near empty condition exists, processor 56 posts a second warning via warning unit 76 that first ink tank 24 must be replaced. Printing may be disabled at this point. Thus, by detecting that the critical pressure CP has been reached and by tracking the number of ink drops expelled after reaching the critical pressure CP, an ink volume of ink jet cartridge 20 can be determined.

By replacing first ink tank 24 with a new first ink tank full of ink, even after printing after the critical pressure CP was reached, the backpressure within ink reservoir 32 will be reduced below the critical pressure CP, and ink will no longer be supplied by second ink tank 26. Upon this occurrence, sensor 30 will be reset to a closed circuit condition, the first signal will be supplied to processor 56, and the tally count will be reset. Also, bladder 46, which may be formed from a foil liner, is re-inflated in second ink tank 26. Ink is pulled from first ink tank 24 while second ink tank 26 is restored to a nearly full condition by the refilling of bladder 46. This action of replacement of first ink tank 24 can occur many times during the life of cartridge 20.

Figure 9:
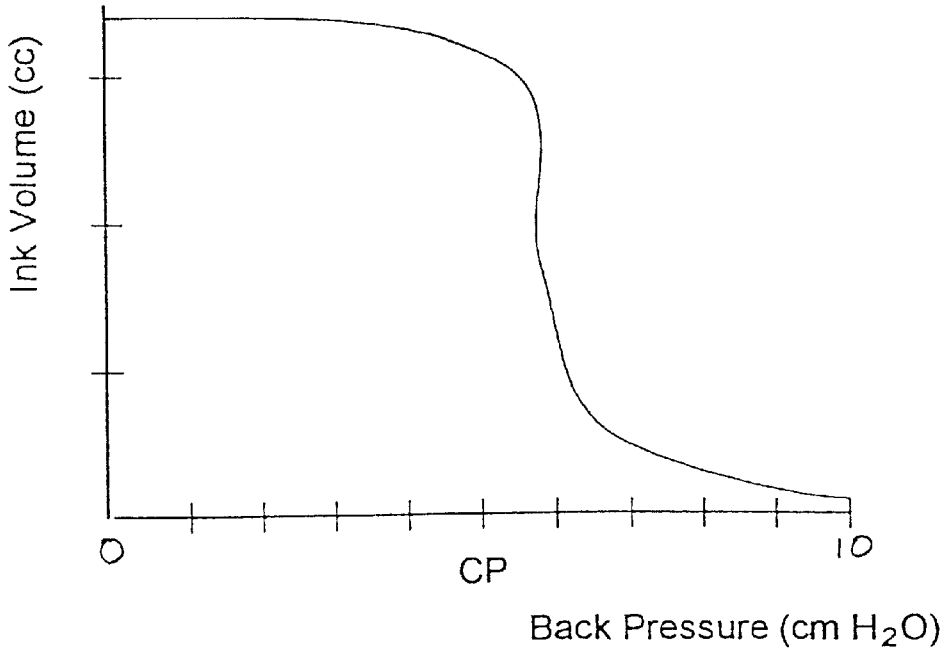
FIG. 9 is a graph plotting backpressure vs. ink volume in an ink tank of the present invention including a modified bladder having a higher sidewall beam strength.
Figure 10:
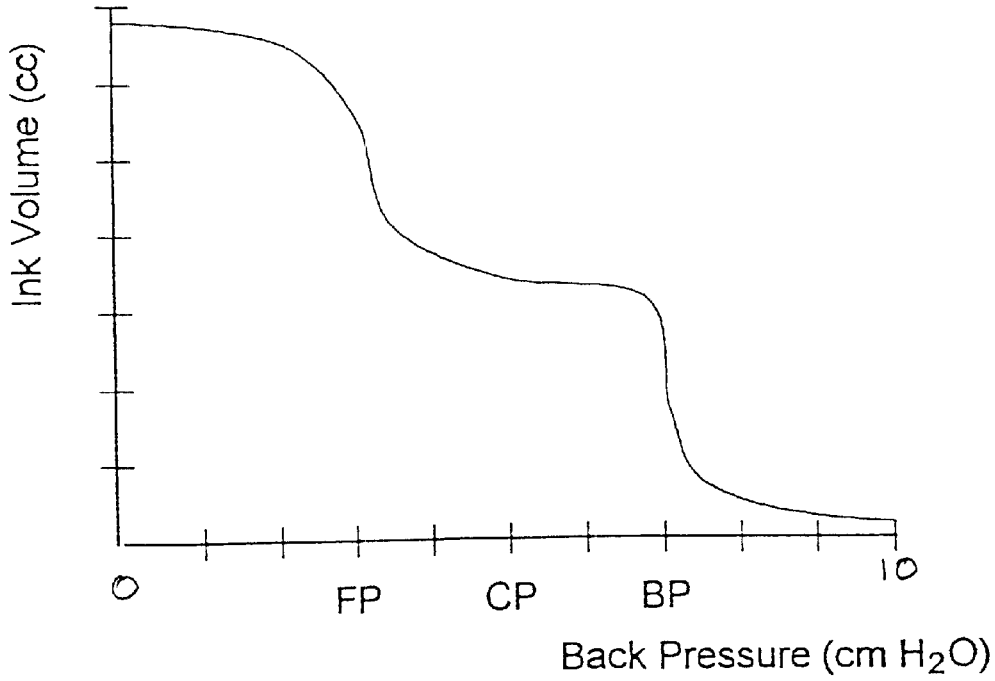
FIG. 10 is a graph plotting backpressure vs. ink volume in an ink jet cartridge of the present invention including the modified bladder of FIG. 9.

As shown in FIGS. 9 and 10, the backpressure/ink volume operating characteristics of the embodiment of FIGS. 3–8 can be further enhanced by increasing the beam strength of a foil forming the sidewalls of bladder 46. Depending on the foil characteristics and ink tank geometry, a high backpressure can be created while second ink tank 26 is nearly full, until the beam strength is overcome and leaf spring 50 controls the interior pressure of second ink tank 26. As can be seen in the graph of FIG. 10 in comparison to the graph of FIG. 8, the combination of first ink tank 24 having a foam insert with second ink tank 26 having enhanced bladder foil beam strength results in an increased backpressure range (wider flat portion of the curve) at an intermediate ink level in ink jet cartridge 20. This wider flat portion of the curve can be used to increase the tolerances in sensor design, i.e., can be used to increase the acceptable range of threshold pressures of sensor 30 about critical pressure CP. In addition, the steeper portion of the curve depicts a reduced total pressure variation in the ink jet cartridge which can simplify the design of a heater chip (not shown) associated with printhead nozzle plate 28.

Figure 11:
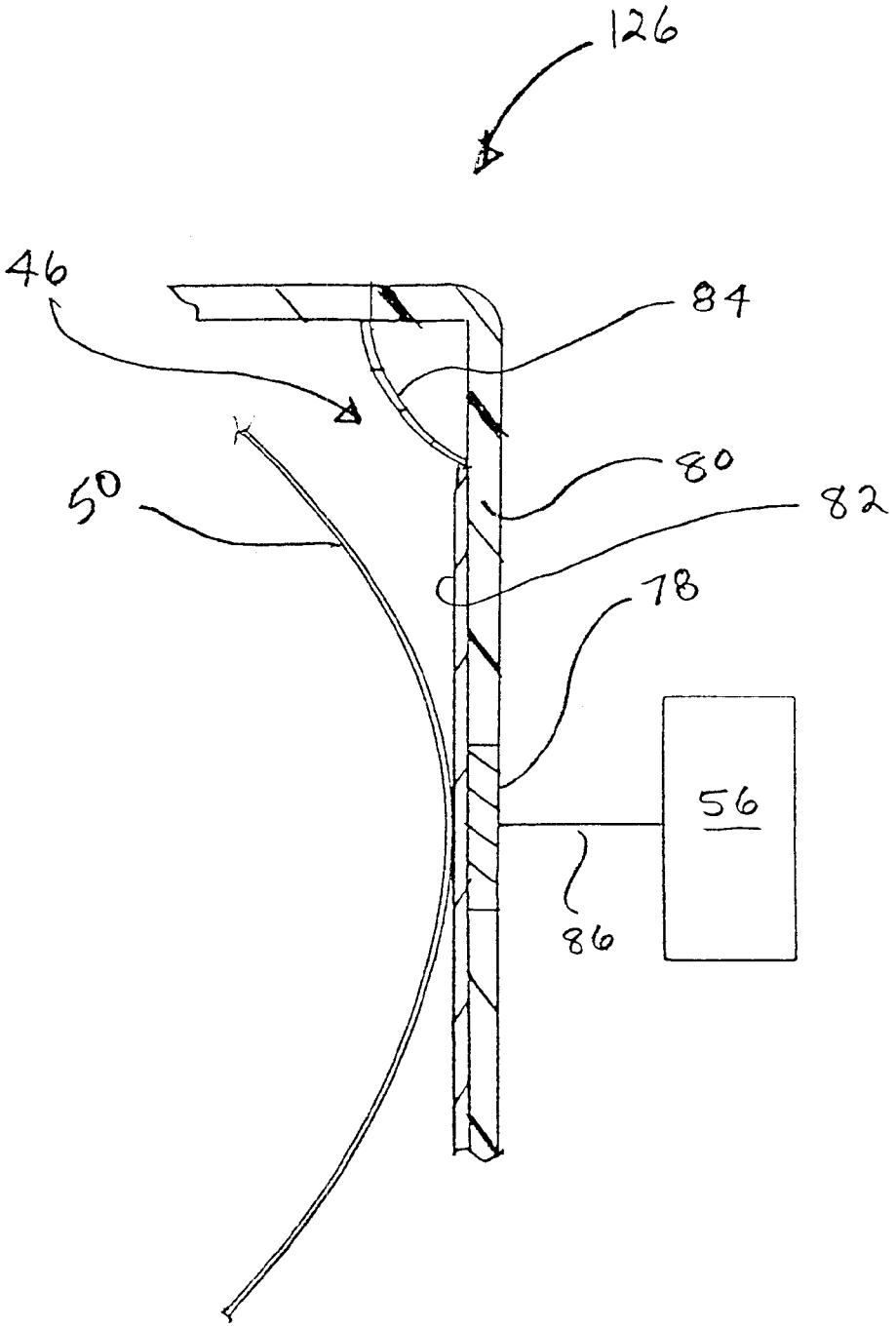
FIG. 11 illustrates another embodiment of the bladder ink tank for use with the ink jet cartridge of the present invention.

In another embodiment of the invention, as shown in FIG. 11, the enhanced backpressure/ink volume operating characteristics depicted in FIGS. 9 and 10 can be achieved by replacing second ink tank 26 with an ink tank 126. Ink tank 126 includes one or more magnetic units 78 (only one shown) which applies a magnetic attraction force to leaf spring 50 and/or bladder 46 on opposing sides of ink tank 126 so as to supplement the force applied by leaf spring 50 to further resist the increase in backpressure within bladder 46. As shown in FIG. 11, bladder 46 is formed from a foil liner having a beam portion 82, preferably metal, which is tied into the housing 80 of second ink tank 126 by a foil 84. The use of magnetic force can simplify the design of second tank 26, since the beam strength is then no longer a significant design parameter. The magnet also assists with the ink refilling process of second ink tank 26.

As shown, each magnetic unit 78 may be an electromagnet having a coil electrically connected to processor 56 via an electrical link 86. Processor 56 selectively controls the operation of each magnetic unit 78 to selectively apply a magnetic force to leaf spring 50 and/or beam 82. Thus, processor 56 is connected in electrical communication with magnetic unit(s) 78 and is connected in electrical communication with sensor 30.

During operation of the ink jet cartridge including ink tank 126, sensor 30 generates the above-described first signal indicating that a pressure threshold associated with critical pressure CP has not been reached and generates the above-described second signal indicating that the pressure threshold associated with critical pressure CP has been reached. Processor 56 responds to the first signal by energizing the electromagnet of magnetic unit(s) 78. Processor 56 responds to the second signal by de-energizing the electromagnet of magnetic unit(s) 78. Thus, processor 56 turns off the current to magnetic unit(s) 78 when ink from ink tank 126 is desired.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An ink cartridge carrying a depletable supply of ink, comprising:

a base assembly forming an ink reservoir;

a first ink tank having a foam core for carrying said ink, said foam core being coupled in fluid communication with said ink reservoir; and a second ink tank having a bladder for carrying said ink, said bladder being coupled in fluid communication with said ink reservoir and coupled in fluid communication with said first ink tank via said ink reservoir.

2. The ink cartridge of claim 1, further comprising a sensor for detecting a pressure change in said ink reservoir corresponding to a substantial depletion of said ink contained in said first ink tank while said second ink tank retains an amount of said ink above a near-full level.

3. The ink cartridge of claim 2, wherein said ink cartridge has an ink volume having a range from full to empty, and wherein said pressure change occurs at an intermediate ink volume level within said range.

4. The ink cartridge of claim 3, wherein said intermediate ink volume level corresponds to an event when said second ink tank is substantially full of ink.

5. The ink cartridge of claim 4, wherein said event corresponds to detecting a critical pressure CP in said ink reservoir by said sensor, said ink cartridge further comprising a processor for tracking a number of ink drops expelled from said ink cartridge following a detection of said critical pressure CP.

6. The ink cartridge of claim 5, wherein after detecting said critical pressure CP, a replacing of said first ink tank with a similar ink tank having a full supply of ink reduces a backpressure in said ink reservoir below said critical pressure CP, and said tracking of said number of ink drops expelled from said ink cartridge by said processor is terminated and said number of ink drops tracked by said processor is reset.

7. The ink cartridge of claim 5, wherein said processor determines an ink volume of said ink cartridge based on both said detecting of said critical pressure CP and said tracking of said number of ink drops expelled.

8. The ink cartridge of claim 2, further comprising:

a spring positioned inside said bladder to resist a collapsing of said bladder;

an electromagnet positioned adjacent said bladder, said electromagnet exerting a magnetic force on at least one of said spring and said bladder to aid said spring in resisting said collapsing of said bladder; and a processor connected in electrical communication with said electromagnet and connected in electrical communication with said sensor, wherein said sensor generates a first signal indicating that a pressure threshold has not been reached and generates a second signal indicating that said pressure threshold has been reached, and wherein said processor responds to said first signal by energizing said electromagnet and said processor responds to said second signal by de-energizing said electromagnet.

9. The ink cartridge of claim 8, wherein said ink jet cartridge has an ink volume range from full to empty, and wherein said pressure change occurs at an intermediate ink volume level within said range, said pressure threshold corresponding to said intermediate ink volume level.

10. The ink cartridge of claim 1, wherein said first ink tank is detachably attachable with said ink reservoir, and said second ink tank is not detachably attachable with said ink reservoir.

11. The ink cartridge of claim 10, wherein said first port comprises a fill pipe coupled to said base assembly in fluid communication with said ink reservoir, and further comprising a screen positioned over a first end of said fill pipe, said first ink tank being fluidly coupled to said ink reservoir via said fill pipe.

12. The ink cartridge of claim 1, further comprising:

a spring positioned inside said bladder to resist a collapsing of said bladder; and a magnet positioned adjacent said bladder, said magnet exerting a magnetic force on at least one of said spring and said bladder to aid said spring in resisting said collapsing of said bladder.

13. A method for detecting a level of ink in an ink cartridge, comprising the steps of:

providing an ink reservoir;

providing a first ink tank having a foam core for carrying said ink, said foam core being coupled in fluid communication with said ink reservoir;

providing a second ink tank having a bladder for carrying said ink, said bladder being coupled in fluid communication with said ink reservoir; and detecting a pressure change in said ink reservoir corresponding to a substantial depletion of said ink contained in said first ink tank while said second ink tank retains an amount of said ink above a near-full level.

14. The method of claim 13, wherein said ink cartridge has an ink volume having a range from full to empty, and wherein said pressure change occurs at an intermediate ink volume level within said range.

15. The method of claim 14, wherein said intermediate ink volume level corresponds to an event when said second ink tank is substantially full of ink.

16. The method of claim 15, wherein said event corresponds to detecting a critical pressure CP in said ink reservoir, said method performing the step of tracking a number of ink drops expelled from said ink cartridge following a detection of said critical pressure CP.

17. The method of claim 16, wherein after detecting said critical pressure CP, a replacing of said first ink tank with a similar ink tank having a full supply of ink reduces a backpressure in said ink reservoir below said critical pressure CP, and said step of tracking is terminated and said number is reset until said critical pressure is again reached.

18. The method of claim 16, further comprising the step of determining an ink volume of said ink cartridge based on both said detecting of said critical pressure CP and said tracking of said number of ink drops expelled.

19. The method of claim 13, wherein said pressure change corresponds to when said second ink tank begins supplying ink to said ink reservoir.

20. The method of claim 13, wherein an ink supply remaining in said second ink tank is determined by tracking a number of ink drops expelled from said ink cartridge following a detection of a critical pressure CP by a sensor.

21. The method of claim 13, wherein said first ink tank is detachably attachable with said ink reservoir, and said second ink tank is not detachably attachable with said ink reservoir.

22. The method of claim 13, further comprising the steps of:

providing a spring positioned inside said bladder to resist a collapsing of said bladder; and providing a magnet positioned adjacent said bladder, said magnet exerting a magnetic force on at least one of said spring and said bladder to aid in resisting said collapsing of said bladder.

23. The method of claim 22, wherein said magnet is an electromagnet, said method further comprising the steps of:

generating a first signal indicating that a pressure threshold has not been reached;

generating a second signal indicating that said pressure threshold has been reached; and energizing said electromagnet by said first signal and de-energizing said electromagnet by said second signal.

24. An ink jet cartridge containing a depletable supply of ink, comprising:

a base assembly forming an ink reservoir, said ink reservoir including a first port, a second port, a third port and a fourth port;

a first ink tank having a foam core for carrying said ink, said foam core being coupled in fluid communication with said first port of said ink reservoir;

a second ink tank having a bladder for carrying said ink, said bladder being coupled in fluid communication with said second port of said ink reservoir;

a printhead nozzle plate coupled in fluid communication with said third port of said ink reservoir; and a sensor coupled in fluid communication with said fourth port of said ink reservoir, said sensor detecting a pressure change in said ink reservoir corresponding to a substantial depletion of said ink contained in said first ink tank while said second ink tank retains an amount of said ink above a near-full level.

25. The ink jet cartridge of claim 24, wherein said ink jet cartridge has an ink volume having a range from full to empty, and wherein said pressure change occurs at an intermediate ink volume level within said range.

26. The ink jet cartridge of claim 25, wherein said intermediate ink volume level corresponds to an event when said second ink tank is substantially full of ink.

27. The ink jet cartridge of claim 26, wherein said event corresponds to detecting a critical pressure CP in said ink reservoir by said sensor, said ink cartridge further comprising a processor for tracking a number of ink drops expelled from said ink cartridge following a detection of said critical pressure CP.

28. The ink jet cartridge of claim 27, wherein after detecting said critical pressure CP, a replacing of said first ink tank with a similar ink tank having a full supply of ink reduces a backpressure in said ink reservoir below said critical pressure CP, and said tracking of said number of ink drops expelled from said ink cartridge by said processor is terminated and said number is reset.

29. The ink jet cartridge of claim 27, wherein said processor determines an ink volume of said ink cartridge based on both said detecting of said critical pressure CP and said tracking of said number of ink drops expelled.

30. The ink jet cartridge of claim 27, further comprising a warning unit, said processor controlling said warning unit to post a first warning message to replace said first ink tank each time said critical pressure CP is reached.

31. The ink jet cartridge of claim 30, said processor controlling said warning unit to post a second warning message indicating that said first ink tank must be replaced when said number of ink drops expelled indicate that said second ink tank is approaching an empty condition.

32. The ink jet cartridge of claim 24, wherein said pressure change corresponds to when said second ink tank begins supplying ink to said ink reservoir.

33. The ink jet cartridge of claim 24, wherein said first ink tank is detachably attachable with said base assembly, and said second ink tank is not detachably attachable with said base assembly.

34. The ink jet cartridge of claim 33, wherein said first port comprises a fill pipe coupled to said base assembly in fluid communication with said ink reservoir, and further comprising a screen positioned over a first end of said fill pipe, said first ink tank being fluidly coupled to said ink reservoir via said fill pipe.

35. The ink jet cartridge of claim 24, further comprising:

a spring positioned inside said bladder to resist a collapsing of said bladder; and a magnet positioned adjacent said base assembly and said bladder, said magnet exerting a magnetic force on at least one of said spring and said bladder to aid in resisting said collapsing of said bladder.

36. The ink jet cartridge of claim 35, wherein said magnet is an electromagnet, said ink jet cartridge further comprising a processor connected in electrical communication with said electromagnet and connected in electrical communication with said sensor, wherein said sensor generates a first signal indicating that a pressure threshold has not been reached and generates a second signal indicating that said pressure threshold has been reached, and wherein said processor responds to said first signal by energizing said electromagnet and said processor responds to said second signal by de-energizing said electromagnet.

37. The ink jet cartridge of claim 36, wherein said ink jet cartridge has an ink volume range from full to empty, and wherein said pressure change occurs at an intermediate ink volume level within said range, said pressure threshold corresponding to said intermediate ink volume level.

* * * * *